US011982281B2

(12) United States Patent
Boigey

(10) Patent No.: US 11,982,281 B2
(45) Date of Patent: May 14, 2024

(54) MULTI-STAGE TURBOMACHINE

(71) Applicant: Cryostar SAS, Hesingue (FR)

(72) Inventor: Jacques Boigey, Sausheim (FR)

(73) Assignee: Cryostar SAS, Hesingue (FR)

( * ) Notice: Subject to any disclaimer, the term of this patent is extended or adjusted under 35 U.S.C. 154(b) by 633 days.

(21) Appl. No.: 17/264,946

(22) PCT Filed: Jul. 10, 2019

(86) PCT No.: PCT/EP2019/068567
§ 371 (c)(1),
(2) Date: Feb. 1, 2021

(87) PCT Pub. No.: WO2020/030373
PCT Pub. Date: Feb. 13, 2020

(65) Prior Publication Data

US 2023/0340959 A1 Oct. 26, 2023

(30) Foreign Application Priority Data

Aug. 7, 2018 (FR) ..... 1857360

(51) Int. Cl.

| | |
|---|---|
| ***F04D 17/12*** | (2006.01) |
| ***F04D 13/06*** | (2006.01) |
| ***F04D 13/12*** | (2006.01) |
| ***F04D 13/14*** | (2006.01) |
| ***F04D 17/16*** | (2006.01) |
| ***F04D 29/043*** | (2006.01) |

(Continued)

(52) U.S. Cl.
CPC ..... *F04D 17/122* (2013.01); *F04D 29/056* (2013.01); *F04D 29/4206* (2013.01); *F04D 13/0633* (2013.01); *F04D 13/0646* (2013.01); *F04D 13/12* (2013.01); *F04D 13/14* (2013.01); *F04D 17/162* (2013.01); *F04D 29/043* (2013.01); *F04D 29/046* (2013.01); *F04D 29/0473* (2013.01); *F04D 29/424* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,599,164 | A | 2/1997 | Murray | |
| 6,725,643 | B1 * | 4/2004 | Paul | F01D 15/10 60/39.162 |

(Continued)

FOREIGN PATENT DOCUMENTS

| | | | |
|---|---|---|---|
| CN | 2606202 | Y | 3/2004 |
| DE | 1122375 | B | 1/1962 |

(Continued)

*Primary Examiner* — Binh Q Tran
(74) *Attorney, Agent, or Firm* — Millen, White, Zelano & Branigan, P.C.; Brion P. Heaney

(57) ABSTRACT

This multi-stage turbomachine comprises:

a central part (2) having at least two bearings (6) from which part there extends at least on one side a shaft (4) guided by said bearings (6) and on which shaft there are mounted, in cantilever fashion, two radial wheels (22, 34), the two radial wheels (22, 34) are separated from one another by a leak-tight partition (32), and each of the two radial wheels (22, 34) is mounted in its casing (24, 32, 40), each casing having a dedicated fluid inlet (24*a*, 42) and a dedicated fluid outlet (24*b*, 44).

9 Claims, 2 Drawing Sheets

(51) Int. Cl.

| | |
|---|---|
| ***F04D 29/046*** | (2006.01) |
| ***F04D 29/047*** | (2006.01) |
| ***F04D 29/056*** | (2006.01) |
| ***F04D 29/42*** | (2006.01) |

(56) References Cited

U.S. PATENT DOCUMENTS

| | | | | |
|---|---|---|---|---|
| 7,856,834 | B2 * | 12/2010 | Haley | F04D 29/441 62/115 |
| 9,816,433 | B2 * | 11/2017 | Hemer | F01D 25/145 |
| 2010/0284824 | A1 * | 11/2010 | Hippen | F02C 6/12 415/110 |
| 2012/0114463 | A1 * | 5/2012 | Beers | F04D 29/462 415/151 |
| 2014/0056721 | A1 * | 2/2014 | Garrard | F04D 29/5806 29/598 |
| 2014/0227079 | A1 * | 8/2014 | Gilarranz | F04D 29/266 415/124.2 |
| 2016/0273548 | A1 * | 9/2016 | Uesugi | F04D 29/5853 |
| 2017/0335756 | A1 * | 11/2017 | Donkin | F04D 25/045 |

FOREIGN PATENT DOCUMENTS

| | | | |
|---|---|---|---|
| EP | 3249234 | A1 | 11/2017 |
| JP | 2012251528 | A | 12/2012 |

* cited by examiner

MULTI-STAGE TURBOMACHINE

The present invention relates to a multi-stage turbomachine. It more specifically relates to the structure of such a machine.

A turbomachine may comprise several compression stages or several expansion stages or even, simultaneously, one or more compression stage(s) associated with one or more expansion stage(s).

It is notably known to have a compressor-turbine-type machine, also called a compander (word obtained from a combination of "compressor" and "expander" for turbine or pressure reducer), wherein one or more centrifugal compressor(s) and one or more turbine(s) are found. These various stages are mechanically connected to a common motor (optionally a common generator) by means of a set of gears called a gearbox.

Such a machine makes it possible to obtain excellent performance levels for fluid treatment. It is modular and the same machine can work with one or more fluids: it is, for example, possible to recover the energy contained in a fluid in order to transmit it to another fluid.

However, a disadvantage of known companders is their footprint which is relatively large.

Another disadvantage of known companders is their structure which requires having a large number of bearings. Indeed, there is a bearing for each turbine wheel or compressor as well as four bearings for the motor and the gearbox. This structure also has several shafts which must be sealed. As a result, the turbomachine obtained is relatively heavy.

Finally, due to the presence of the gearbox, it is usually necessary to have oil in order to lubricate said gearbox. For some applications, it is preferable not to have oil and the presence of the gearbox is thus a disadvantage.

The purpose of the present invention is therefore to provide a multi-stage turbomachine able, like companders, to treat different fluids—for example a gas and a liquid—which does not have all of the above-mentioned disadvantages.

Thus, the novel turbomachine will preferably have a more compact structure. This turbomachine, at equivalent performance levels, will also preferably be lighter than a compander. Advantageously, this turbomachine will operate without oil.

To this end, the present invention proposes a multi-stage turbomachine comprising a central part having at least two bearings from which part there extends at least on one side a shaft guided by said bearings and on which shaft there are mounted, in cantilever fashion, two radial wheels.

According to the present invention, the two radial wheels are separated from one another by a leak-tight partition and each of the two radial wheels is mounted in its casing, each casing having a dedicated fluid inlet and a dedicated fluid outlet.

This structure makes it possible to obtain a turbomachine comparable to a compander with four stages with a smaller footprint whilst making it possible to work with several fluids (at least two fluids, as at least two casings each have a dedicated inlet and outlet, i.e. which are not shared with another stage).

In order to facilitate the supply to the two radial wheels and to have a compact structure, the two radial wheels mounted on the same cantilever are for example mounted back to back. Thus, one wheel is supplied on one side and the other on the opposite side.

In order to limit the number of parts and to have a compact structure, it can be provided that the leak-tight partition forms a common wall with each of the two casings.

In order to be able to use fluids at substantially different temperatures, the leak-tight partition advantageously has thermal insulation.

A multi-stage turbomachine as disclosed hereinbefore is intended to be used in a thermodynamic process. For better management of this process, it is advantageously provided that the central part further comprises an electric group selected from the set of electric motors and electric generators.

According to an advantageous embodiment, the casing corresponding to the distal wheel comprises a proximal part shared with the casing of the proximal wheel and a distal part fixed to the casing of the proximal wheel.

In order to obtain a structure equivalent to a compander, a multi-stage turbomachine as disclosed hereinbefore may comprise on either side of its central part an assembly of two radial wheels, separated from one another by a leak-tight partition, and, for each assembly, each of the radial wheels is mounted in its casing, each casing having a dedicated fluid inlet and a dedicated fluid outlet.

Details and advantages of the present invention will become apparent from the following description, made in reference to the enclosed schematic drawing, whereupon:

Figure 1:
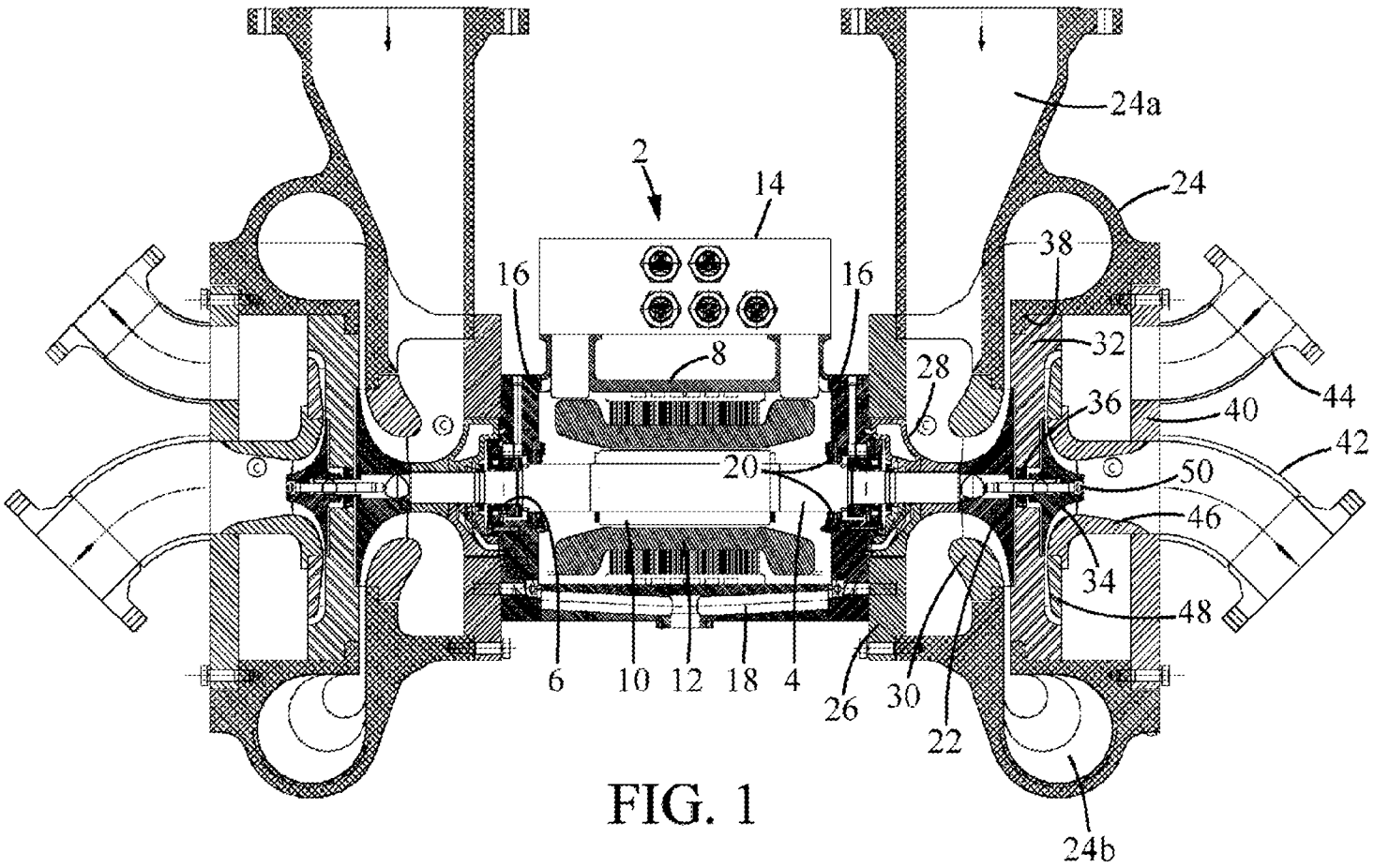
FIG. 1 is a cross sectional view of a multi-stage turbomachine.

In the embodiment illustrated in FIG. 1, there is a turbomachine with four independent stages. The overall structure of this machine is disclosed hereinafter. An electric group 2, which may be a motor or a generator, is arranged in a central position. It is traversed by a shaft 4 supported by bearings 6 and having cantilevered shaft ends. Each shaft end carries two radial wheels.

The electric group 2 is mounted in a unit 8. A magnet 10 is shrink-fitted on the shaft 4 and forms the rotor of the electric group 2. A stator 12, separated from the rotor by an air gap and having windings, is fixedly mounted in the unit 8. A junction box 14 makes it possible to electrically connect the electric group 2.

The unit 8 is closed on either side by a cover 16 which integrates a bearing 6 which is herein a hydrodynamic bearing. The unit 8 integrates an oil manifold 18. To prevent any migration of oil towards the electric group 2, seals 22 are provided inside each cover 16.

The bearings 6 of the shaft 4 are thus integrated in the covers 16. The parts of the shaft 4 outwardly extending from the unit 8 (or more specifically from its covers 16) are arranged in cantilever fashion in relation to the support of this shaft 4.

FIG. 1 shows that the two assemblies of radial wheels arranged on either side of the electric group 2 are symmetrical. Thus, in the following description, a single assembly, that on the right in FIG. 1, will be disclosed.

A first compressor is mounted adjacent to the cover 16 located on the right in FIG. 1. This compressor comprises a first compressor wheel 22 and a first compression body in several parts.

The first compressor wheel 22 is mounted on the shaft 4 and driven by the latter. The fluid (in gas or liquid phase) enters the first compressor wheel 22 in an axial direction (given by the axis of the shaft 4), from left to right in FIG. 1. In the preferred embodiment illustrated in FIG. 1, the shaft 4 has a so-called polygonal shaped section at the first compressor wheel 22. The section of the shaft 4 herein is of triangular shape (with slightly convex faces and rounded apexes).

The first compression body guides the fluid supplying the first compressor wheel 22 upstream and downstream thereof. A casing 24 has an inlet 24*a* which channels the fluid supplying the first compressor wheel 22 in a radial direction as well as an outlet 24*b* which guides the compressed fluid downstream of the first compressor wheel 22. The casing 24 is fixed on a support 26 mounted on the corresponding cover 16. This support 26 has an inner wall which is also involved in guiding the fluid to direct it to the first compressor wheel 22. A sealing part 28 is arranged between the support 26 and the shaft 4 to seal the compressor. In the illustrated embodiment, the sealing part 28 has a labyrinth on the side of the shaft 4. On the inside of the casing 24, the sealing part guides the fluid to move it from a radial direction to its axial direction in order to supply the first compressor wheel 22. Finally, inside the casing 24, a deflector 30 guides the fluid upstream of the first compressor wheel 22 and opposite thereto.

After the first compressor wheel 22, i.e. moving away from the central part of the turbomachine which incorporates the electric group 2, a transverse wall 32 separates the first compressor from a second compressor. This second compressor comprises a second compressor wheel 34 as well as a compression body also in several parts.

The transverse wall 32, as its name suggests, extends perpendicular to the axis of the shaft 4. It has an annular form and in its center houses a sealing device 36. At this level, the shaft 4 also has a section of polygonal shape (triangular). To achieve the seal, a ring having an inner surface matching the polygonal shape of the shaft 4 and an outer circular cylindrical surface is positioned around the shaft 4. The sealing is thus for example produced on said ring by a labyrinth sealing system.

The transverse wall 32 has a face receiving the rear face of the first compressor wheel 22 and a face receiving the rear face of the second compressor wheel 34. The rear face of a wheel is herein the face with the largest diameter. As can be seen here, the two compressor wheels (first compressor wheel 22 and second compressor wheel 34) are thus mounted back to back. Each face of the transverse wall 32 has a housing to receive the rear face of the corresponding compressor wheel. Beyond this housing, each face of the transverse wall 32 forms a wall for the corresponding compressor diffuser.

The casing 24 is configured on the rear side of the first compressor wheel 22 in order to receive the transverse wall 32. To that end, it has a hollow housing, preferably with a shoulder 38, in order to receive the transverse wall 32. The housing at the bottom of which the transverse wall 32 is seated is closed by a plate 40 carrying a fluid inlet pipe 42 and an outlet pipe 44. The plate 40 is fixed to the casing 24.

The inlet pipe 42 is arranged in a central position and it guides fluid towards the second compressor wheel 34 such that this fluid is oriented axially heading, in FIG. 1, for the second compressor wheel 34 on the right, from the right to the left. Inside the housing, a guide 46 ensures the guidance of fluid towards the second compressor wheel 34 and into this wheel. When exiting the wheel, the compressed fluid is guided by a diffuser 48 (and by the transverse plate 32).

The second compressor wheel 34 is also mounted on a segment of the shaft 4 having a polygonal section. However, it is noted that the second compressor wheel 34 is mounted on a segment having smaller dimensions ("diameter") than the segment of the shaft 4 receiving the first compressor wheel 22. A bolt 50 fastens the second compressor wheel 34 at the end of shaft 4. This fastening ensures, by stacking, the fastening of various elements arranged on the shaft 4, such as the sealing devices and the first compressor wheel 22.

It is herein noted that the two compression bodies are both embedded in each other, with common elements, and both independent as two distinct fluid circuits are created.

In this way, two stages are produced, entirely independent of each other, on the same shaft end of a turbomachine.

Figure 2:
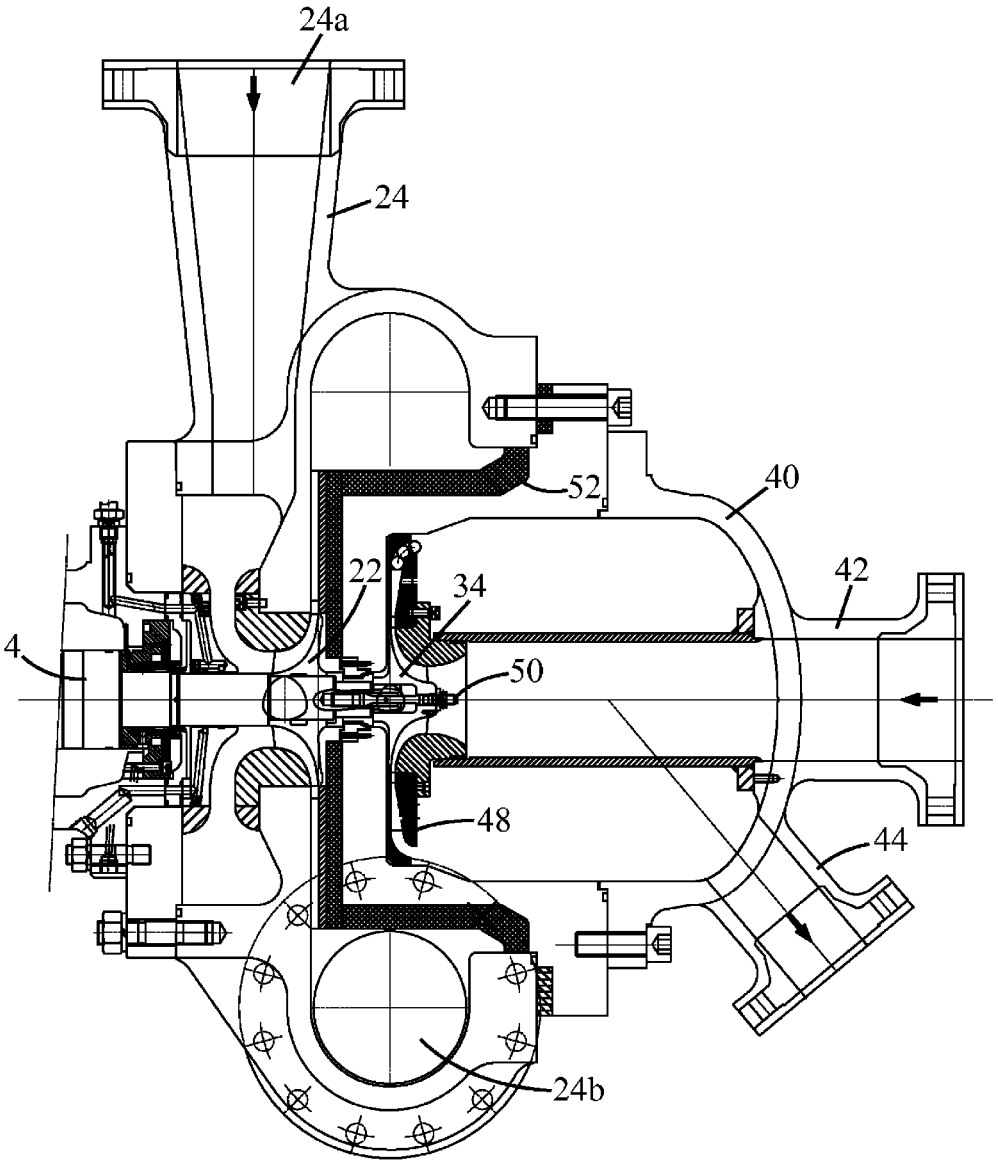
FIG. 2 is a partial enlarged cross sectional view of an embodiment of the turbomachine in FIG. 1.

FIG. 2 illustrates an embodiment of FIG. 1. It reuses the references from FIG. 1 to designate similar parts. We herein find two radial wheels separated by a partition and mounted back to back, the two wheels being mounted on the same cantilever of a shaft. FIG. 2, which is a partial enlarged section, also shows a bearing (which is, in this example, also a hydrodynamic bearing but which may be any other type, "conventional" with roller bearings or even magnetic bearings, air bearings, etc.). Additionally, the compressor body corresponding to the first compressor wheel or proximal wheel (the closest to the bearing) is of a suitable shape and has a housing in order to partially receive the compressor body corresponding to the second compressor wheel. Hereinafter, only the differences between the embodiment in FIG. 2 and that in FIG. 1 will be given.

On the side of the central part, the cover 16 and the support 26 in FIG. 1 are both grouped together into a single part on which the casing 24 is mounted. The structure of the hydrodynamic bearing and the seal is subject to review. The sealing part thereby has a different shape.

The embodiment in FIG. 2 corresponds for example to a turbomachine intended to work with two fluids at very different temperatures. An insulating layer 52 is thus recognized which is arranged in the second compression body opposite the first compression body. It is herein possible, for example, to compress a cryogenic fluid and another fluid at "normal" temperature, for example close to ambient temperature.

The pressure in the second compression body in this other embodiment is relatively high. Therefore, the plate 40 closing this body and separating it from the exterior is of convex shape. The fluid supply is thus adapted.

The embodiments disclosed hereinbefore therefore have multi-stage turbomachines, said stages being able to be mutually independent.

FIG. 1 illustrates a four-stage machine which is symmetrical. This symmetry is for illustrative purposes only. It is possible to have two very distinct assemblies on either side of the central part of the machine.

The turbomachine proposed herein has a single shaft and no gearbox. It may thus have a limited footprint in comparison to a "compander" type machine disclosed in the preamble. The number of bearings and seals to be produced is reduced in comparison to a "compander".

The turbomachine, in its proposed version with four stages (it may only have for example two or three stages, i.e. two stages on one side and one or zero on the other) or, quite the contrary, a greater number of stages.

The proposed turbomachine may also comprise one or more expansion wheels (and not only compression stages). It is then used in a thermodynamic installation. It may drive in the case where a motor is arranged in the central part, or may even generate if a generator is provided in the central part. It may also involve an exchange between fluids, one or more pressure reducers thus transmitting energy to one or more compressors by means of the central shaft. For a four-stage machine, it is thus possible to have several configurations depending on whether there are compressors or expansion turbines (or "expanders"). It is thus possible to have the following configurations with a motor:

Turbine-turbine/motor/compressor-compressor
Turbine-turbine/motor/turbine-compressor
Turbine-turbine/motor/compressor-turbine
Turbine-compressor/motor/compressor-compressor
Turbine-compressor/motor/turbine-compressor
Turbine-compressor/motor/compressor-turbine
Compressor-turbine/motor/compressor-compressor
Compressor-turbine/motor/turbine-compressor
Compressor-turbine/motor/compressor-turbine
Compressor-turbine/motor/turbine-turbine
Compressor-compressor/motor/compressor-compressor Similarly with a generator at the central part, it is possible to have any possible combination of turbine and compressor on either side of the generator (except only having compressors which cannot thus drive the generator).

Similarly all combinations of turbines and compressors (except only turbines or only compressors) may be envisaged without an electric group at the central part to perform energy exchanges between fluids only via the central shaft.

Each time, there is, at least on one side of the central part, an assembly of two radial wheels, preferably mounted back to back, on the same cantilever of a common shaft, a sealing device between the two radial wheels. The compression or expansion bodies corresponding to these two radial wheels are embodied in order that each is able to receive a different fluid. Each body thus has a fluid inlet and outlet and there are two totally distinct circuits; the inlet and the outlet of one body and the inlet and the outlet of the other body.

In the purely descriptive and non-limiting disclosure, the radial wheels shown are mounted on the shaft by "polygon" type zones. Obviously other configurations are possible: keys, teeth, Hirth type couplings, etc.

The outermost wheel is preferably, but not necessarily, mounted on a segment of the shaft with a smaller section. Mounting on two identical sections can also be envisaged. The wheels are mounted using any means: thrust washers, bushes, labyrinth seal, etc.

The compression or expansion body corresponding to the outermost wheel, or distal wheel, is preferably fixed to the body (compression or expansion body) corresponding to the innermost wheel. Thermal insulation may be provided between the two bodies.

The present invention is not limited to the embodiments disclosed hereinbefore and to the envisaged variants. It also relates to the embodiments within the abilities of a person skilled in the art in the context of the claims hereinafter.

The invention claimed is:

1. A multi-stage turbomachine comprising:

a central part having at least two bearings (6) from which part there extends at least on one side a shaft (4) guided by said bearings (6) and on which shaft there are mounted, in cantilever fashion, two radial wheels (22, 34), one radial wheel being a proximal wheel (22), relative to the central part, and the other radial wheel being a distal wheel (34), relative to the central part, wherein the two radial wheels (22, 34) are separated from one another by a leak-tight partition (32), the leak-tight partition (32) having a thermal insulation (52), and in that each of the two radial wheels (22, 34), is mounted in a casing (24, 32, 40), each casing having a dedicated fluid inlet (24*a*, 42) and a dedicated fluid outlet (24*b*, 44) and the casing (32, 40) corresponding to the distal wheel (34) comprises a proximal part (32), relative to the central part, which is shared with the casing corresponding to the proximal wheel (22), and a distal part (40), relative to the central part, which is fixed to the casing (24) corresponding to the proximal wheel (22).

2. The multi-stage turbomachine according to claim 1, wherein the two radial wheels (22, 34) are mounted on the shaft in a back to back arrangement.

3. The multi-stage turbomachine according to claim 1, wherein the leak-tight partition (32) forms a common wall with each of the two casings (24, 32, 40).

4. The multi-stage turbomachine according to claim 1, wherein the central part (2) further comprises an electric group selected from electric motors and electric generators.

5. The multi-stage turbomachine comprising:

a central part having at least two bearings (6) from which part there extends, on both sides thereof, a shaft (4) guided by said bearings (6) and on either end of said shaft there is mounted an assembly of two radial wheels (22, 34), one radial wheel being a proximal wheel (22), relative to the central part, and the other radial wheel being a distal wheel (34), relative to the central part, wherein the two radial wheels (22, 34) are of each assembly are separated from one another by a leak-tight partition (32), the leak-tight partition (32) having a thermal insulation (52), and in that, for each assembly, and in each assembly each of the radial wheels (22, 34) is mounted in a casing (24, 32, 40), each casing having a dedicated fluid inlet (24*a*, 42) and a dedicated fluid outlet (24*b*, 44) and in each assembly the casing (32, 40) corresponding to the distal wheel (34) comprises (a) a proximal part (32), relative to the central part, which is shared with the casing corresponding to the proximal wheel (22), and (b) a distal part (40), relative to the central part, which is fixed to the casing (24) corresponding to the proximal wheel (22).

6. The multi-stage turbomachine according to claim 1, wherein the leak-tight partition (32) extends perpendicular to an axis of said shaft, said the leak-tight partition (32) having a center portion which houses a sealing device (36) which engages the surface of shaft (4).

7. The multi-stage turbomachine according to claim 6, wherein, at the point where said sealing device engages the surface of shaft (4), the surface of shaft (4) has a polygonal shape and said sealing device (36) comprises a ring having an inner surface matching the polygonal shape of the shaft (4).

8. The multi-stage turbomachine according to claim 7, wherein said ring has an outer circular cylindrical surface is positioned around the shaft (4).

9. The multi-stage turbomachine according to claim 1, wherein each of the radial wheels has two faces wherein one of these two faces is a rear face which has the larger diameter of the two faces, and wherein the leak-tight partition (32) has a first face that receives the rear face of the proximal radial wheel (22) and a second face that receives the rear face of the distal radial wheel (34).

* * * * *